US006663421B1

(12) United States Patent
Glick et al.

(10) Patent No.: US 6,663,421 B1
(45) Date of Patent: Dec. 16, 2003

(54) IGNITER SHORTING CONTACT

(75) Inventors: Michael Glick, Farmington Hills, MI (US); William R. Lyons, Southfield, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/316,435

(22) Filed: Dec. 11, 2002

(51) Int. Cl.[7] ..... H01R 31/08
(52) U.S. Cl. ..... 439/507; 439/188; 200/51.1
(58) Field of Search ..... 439/507, 188, 439/181, 944; 200/51.1

(56) References Cited

U.S. PATENT DOCUMENTS 5,733,135 A 3/1998 Kennedy et al. ..... 439/188
6,203,342 B1 * 3/2001 Gauker et al. ..... 439/188
6,257,910 B1 * 7/2001 Mramor ..... 439/188
6,358,084 B1 3/2002 Rieger et al. ..... 439/507
6,422,897 B1 * 7/2002 Odorfer ..... 439/188
6,544,060 B2 * 4/2003 Wakui et al. ..... 439/188

FOREIGN PATENT DOCUMENTS

FR 2743624 7/1997

* cited by examiner

*Primary Examiner*—Tho D. Ta
(74) *Attorney, Agent, or Firm*—Harrington & Smith, LLP

(57) ABSTRACT

An igniter shorting contact for an igniter connector including a base, at least one deflectable contact arm, and a contact leg. The base is adapted to be mounted to an insulating housing member of a housing of the igniter connector. The deflectable contact arm(s) extend from the base and are adapted to contact electrical terminals of the igniter connector. The contact leg extends from the base. The contact leg is adapted to extend radially outward relative to the insulating housing and contact an outer electrically conductive housing member of the igniter connector.

13 Claims, 5 Drawing Sheets

IGNITER SHORTING CONTACT

BACKGROUND OF THE INVENTION

1. Field of the Invention

The present invention relates to electrical connectors and, more particularly, to a shorting contact used in an electrical connector.

2. Brief Description of Prior Developments

It is known to protect a vehicle occupant by inflating an air bag with inflation fluid from an air bag inflator. The inflation fluid is released from a container in the inflator and/or generated by ignition of combustible gas generating material in the inflator.

The inflator may use an electrically actuatable initiator to open the container and/or to ignite the gas generating material. A typical initiator has two terminals. The terminals are in electrical contact with an electrical connector which is part of vehicle electric circuitry. To actuate the inflator, the vehicle electric circuitry sends an electric signal through the electrical connector and the terminals to the initiator. The electric signal actuates the initiator, resulting in actuation of the inflator.

U.S. Pat. No. 5,733,135 describes an inflator having an initiator that includes a metal retainer onto which a shorting clip is crimped. Prior to connection of an electrical connector with terminals of the initiator, the shorting clip has electrically conductive portions connected between the terminals to prevent accidental actuation of the initiator. The shorting clip has an opening to receive the electrical connector when the inflator is connected with vehicle electric circuitry. The shorting clip physically maintains the electrical connector in electrical contact with the terminals of the initiator.

There is a need for an initiator to dissipate static electricity. Dissipating static electricity prevents the initiator from accidentally discharging because of static electricity. In the past, one solution for preventing static electricity from accidentally discharging the initiator was to dissipating static electricity by making the housing partially conductive. An electrically conductive carbon filler was added to plastic of the initiator housing. However, the housing still needs to be electrically insulating in order to housing the electrical terminals of the initiator. A disadvantage with this type of solution was that it resulted in a relatively expensive manufacturing process.

Another solution used in the past it dissipate static electricity was the use of an electrically conductive ring which was used to connect a shorting contact to the outer metal can. However, this increased the cost of manufacture because of the assembly process and cost of an addition piece for the initiator.

There is a need to provide an initiator which can dissipate static electricity, but which is less expensive to manufacture than a plastic housing having electrically conductive carbon filler. There is also a need to provide an initiator which can dissipate static electricity, but which is less expensive to manufacture than an initiator having an additional metal ring connecting the shorting contact to the outer metal can.

SUMMARY OF THE INVENTION

In accordance with one aspect of the present invention, an igniter shorting contact for an igniter connector is provided including a base, at least one deflectable contact arm, and a contact leg. The base is adapted to be mounted to an insulating housing member of a housing of the igniter connector. The deflectable contact arm(s) extending from the base and are adapted to contact electrical terminals of the igniter connector. The contact leg extends from the base. The contact leg is adapted to extend radially outward on the insulating housing and contact an outer electrically conductive housing member.

In accordance with another aspect of the present invention, a gas generator igniter connector is provided comprising a housing having an inner electrically insulating member and an outer electrically conductive member; electrical terminals mounted to the insulating member; and a shorting contact connected to the housing. The shorting contact comprises a first deflectable contact section adapted to contact the electrical terminals and a second contact section directly electrically connected to the outer electrically conductive member of the housing. The shorting contact directly connects the terminals to each other and to the outer electrically conductive member.

In accordance with one method of the present invention, a method of assembling a gas generator igniter connector is provided comprising steps of inserting a shorting contact into an insulating housing member of the connector; contacting electrical terminals of the connector with first deflectable contact sections of the shorting contact; and contacting an electrically conductive housing member of the connector with a second contact section of the shorting contact, wherein the shorting contact electrically connects the terminals to each other and to the electrically conductive housing member.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
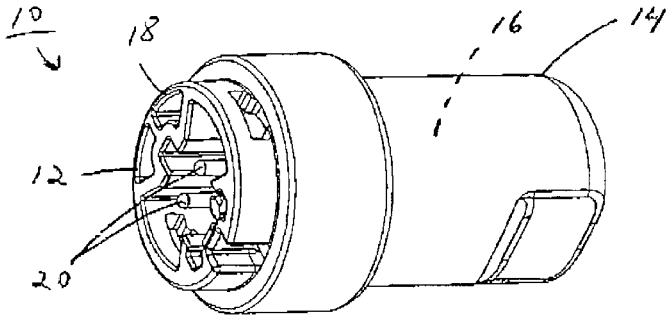
FIG. 1 is a perspective view of a gas generator igniter having a connector incorporating features of the present invention.
Figure 2:
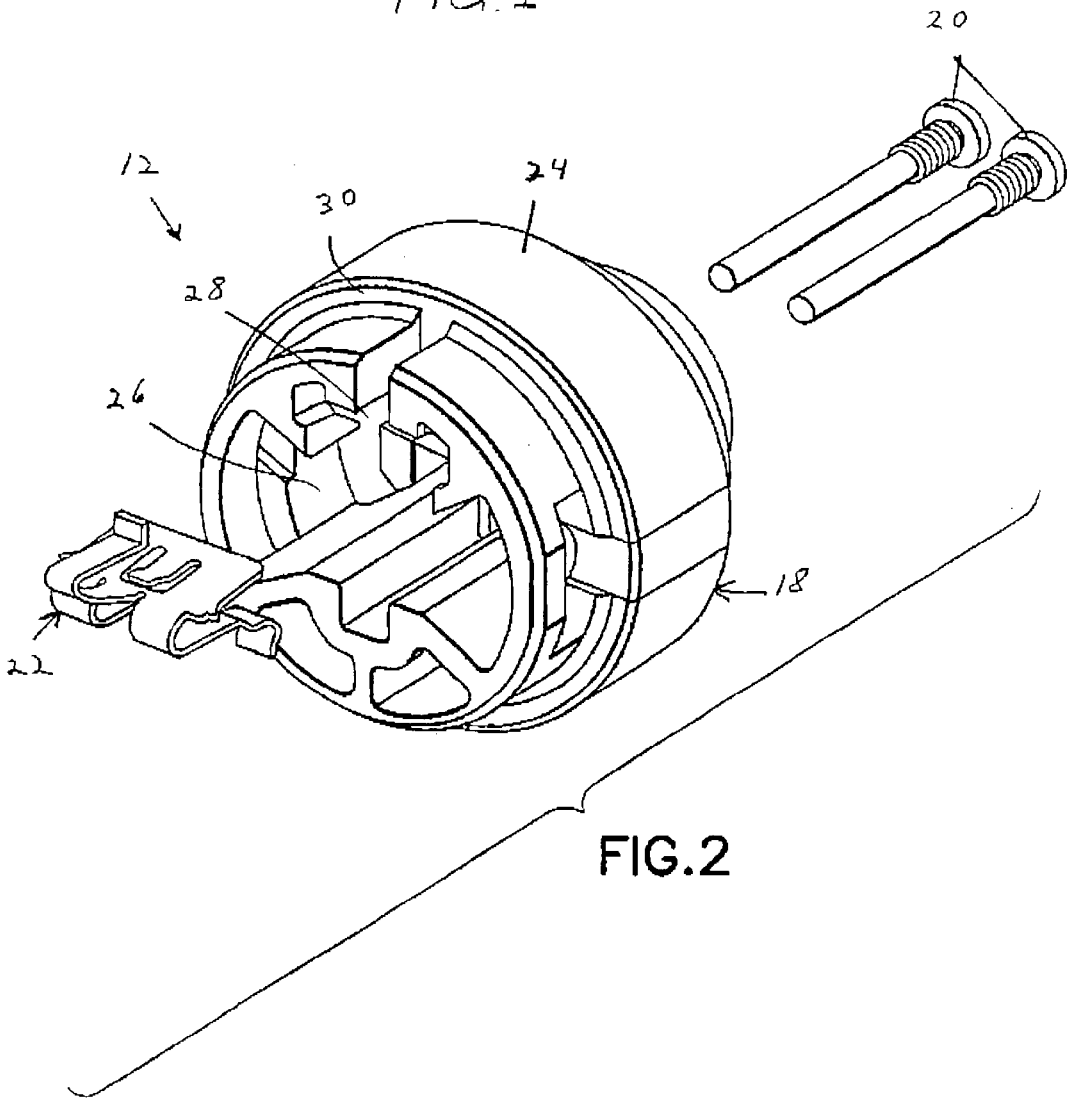
FIG. 2 is an exploded perspective view of the gas generator igniter connector shown in FIG. 1.

Referring to FIG. 1, there is shown a perspective view of a gas generator igniter 10 (also referred to as a molded initiator assembly) incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

The igniter 10 is preferably for use with a micro-gas generator (MGG). However, the igniter could be used with any suitable device. The igniter 10 generally comprises an electrical connector 12, an outer housing or can 14, and an initiator or ignition material 16. The ignition material 16 is contained within the outer housing 14. The outer housing 14 is mechanically wrapped around an annular outer ring of the connector 12. The electrical connector 12 generally comprises an inner housing member 18, electrical terminals 20 and a shorting contact 22.

The inner housing member 18 is preferably comprised of a molded plastic or polymer material. The inner housing member 18 preferably also functions as a retainer; the retainer feature being molded into the inner housing member. In a preferred embodiment, the inner housing member 18 does not comprise an electrically conductive filler, such as a carbon filler. Instead, the inner housing member 18 can be comprised of merely dielectric material.

The inner housing member 18 generally comprises the annular outer ring 24, a mating connector receiving area 26, and a shorting contact receiving areas 28. The rear end of the inner housing member 18 includes apertures 46 (see FIG. 5) for mounting the electrical terminals 22 therein. The front end of the electrical terminals 22 extend into the mating connector receiving area 26. The annular outer ring 24 forms a ledge 30 facing the front side of the inner housing member 18. The mating connector receiving area 26 is sized and shaped to receive a portion of a mating electrical connector (not shown) and allow contacts of the mating connector to make electrical connection with the electrical terminals 20.

Figure 3:
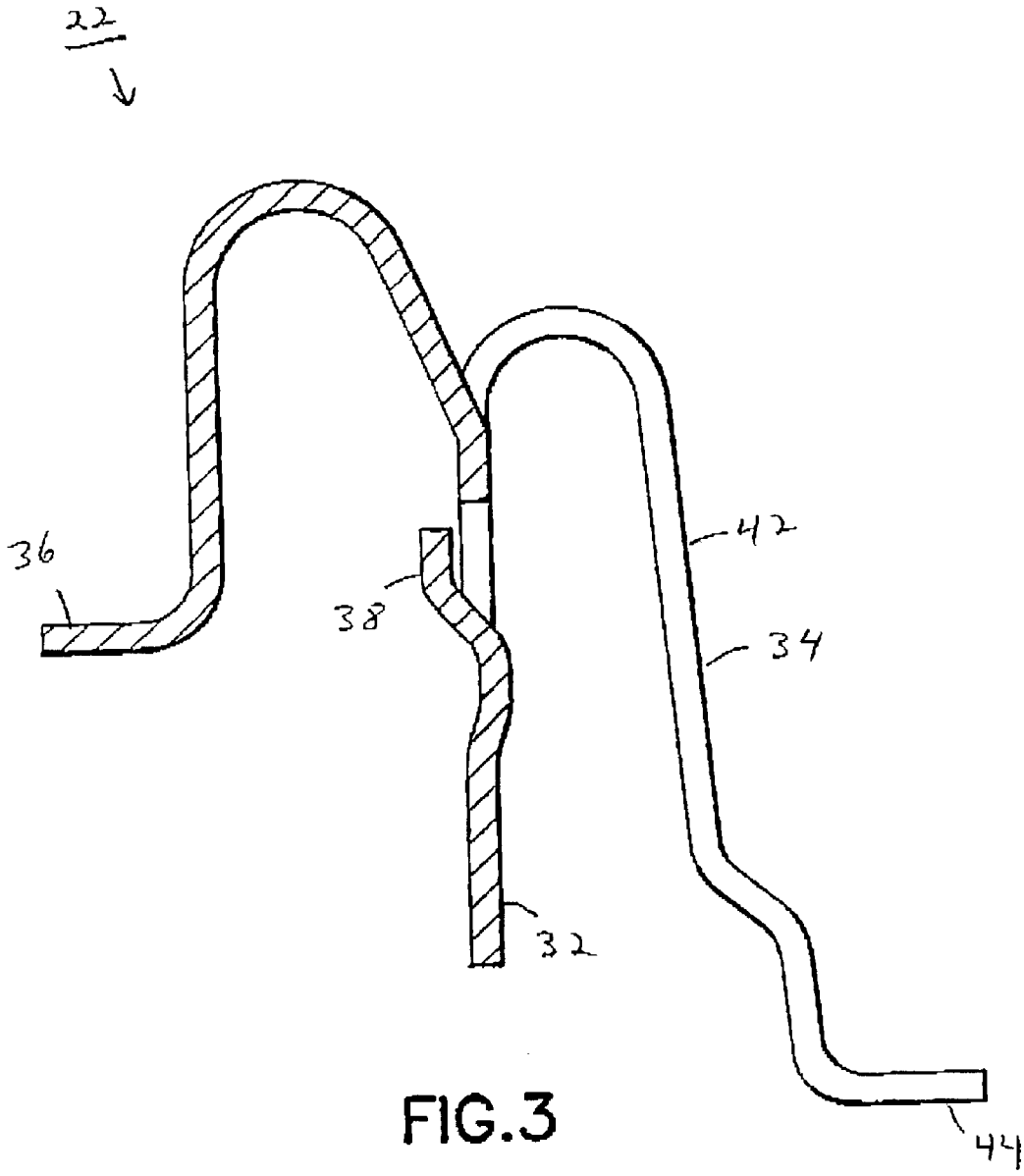
FIG. 3 is a cross sectional view of the igniter shorting contact of the connector shown in FIG. 2.
Figure 4:
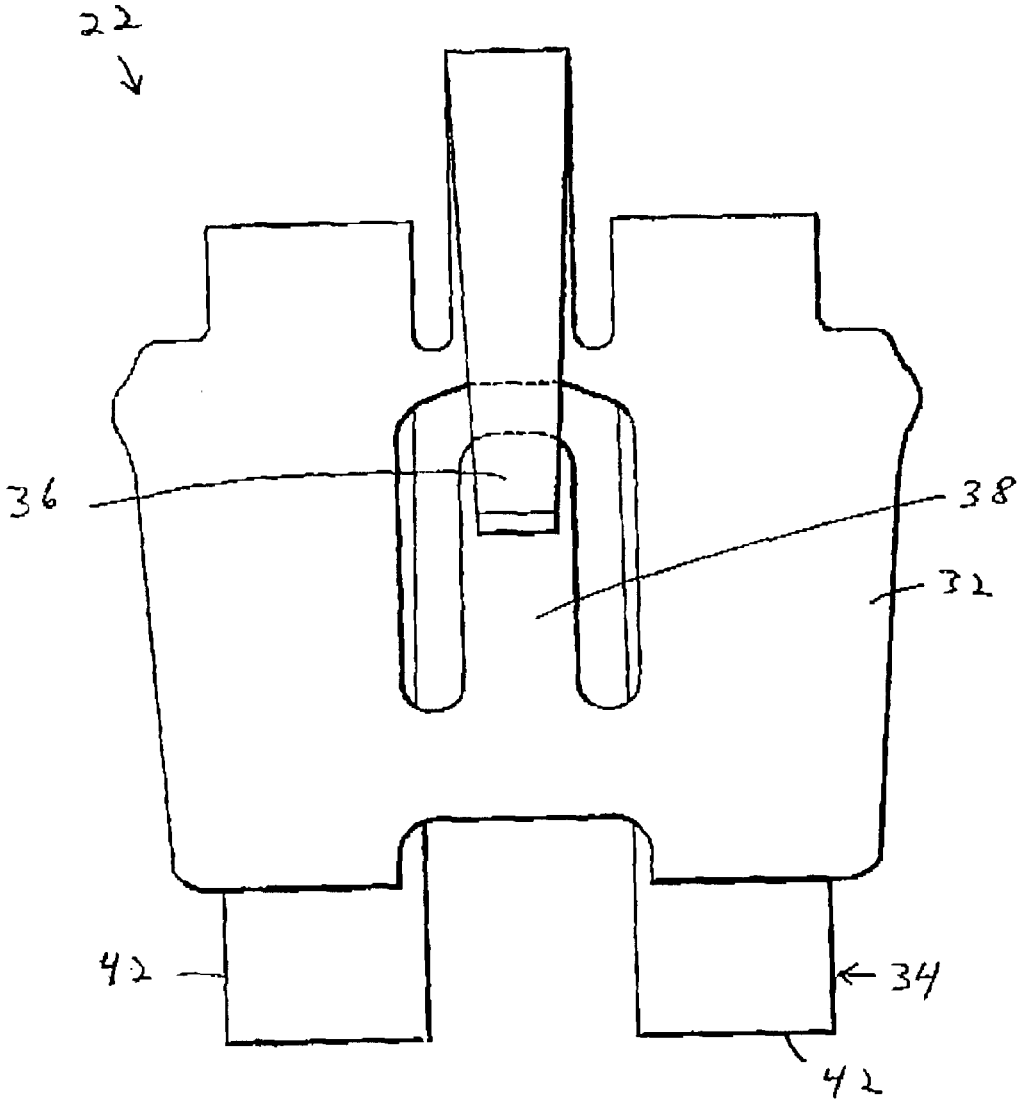
FIG. 4 is a rear side elevational view of the igniter shorting contact shown in FIG. 3.
Figure 5:
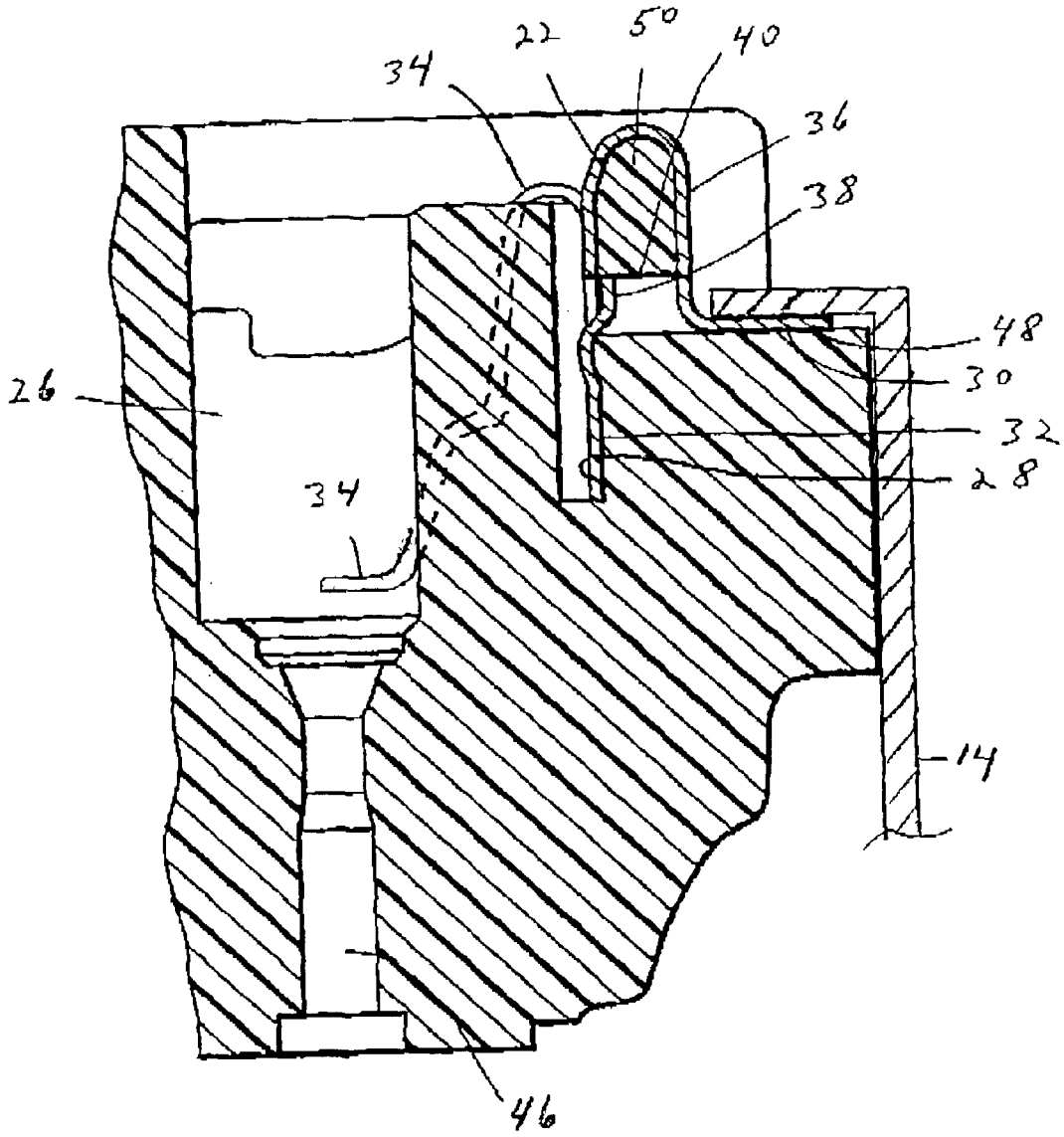
FIG. 5 is a partial cross sectional view of the igniter shorting contact shown in FIG. 3 shown mounted to the housing of the connector.

The shorting contact receiving area 28 is sized and shaped to receive the shorting contact 22 and allow portions of the shorting contact 22 to extend into the mating connector receiving area 26 and onto the ledge 30. Referring also to FIGS. 3–5, the shorting contact 22 generally comprises a base section 32, a first contact section 34 and a second contact section 36. The shorting contact 22 is preferably comprised of sheet metal which has been stamped and formed into the shape shown. Portions of the shorting contact may be plated with suitable plating material.

The base section 32 is sized and shaped to fixedly attach the shorting contact 22 to the inner housing member 18. In the embodiment shown, the base section 32 is substantially flat except for a mounting section 38. The mounting section 38 comprises a deflectable tab. As seen with reference to FIG. 5, the shorting contact receiving area 28 comprises a snap lock ledge 40 therein. When the base section 32 is inserted into the shorting contact receiving area 28 the mounting section 38 is adapted to deflect and snap lock mount behind the snap lock ledge 40. However, in alternate embodiments, any suitable type of system for mounting the shorting contact to the inner housing member could be provided. For example, the base section could comprise lateral mounting barbs for piercing into the inner housing member.

The first contact section 34 comprises two cantilevered deflectable arms 42. However, in alternate embodiments, the first contact section 34 could comprise more or less than two cantilevered deflectable arms. The two arms 42 are substantially identical to each other. However, in alternate embodiments, the arms could comprise different shapes and/or sizes. The arms 42 extend upward from a top side of the base section 32 and are bent towards a downward direction. Bottom ends 44 of the arms 42 extend in an inward direction when mounted to the inner housing member 18. End tips of the bottom ends 44 are adapted to contact the electrical terminals 20. Thus, the shorting contact 22 is adapted to electrically connect the two electrical terminals 20 to each other. The cantilevered arms 42 are resiliently deflectable away from the electrical terminals 20 when the mating electrical connector (not shown) is inserted into the mating connector receiving area 26.

The second contact section 36 comprises a contact leg which extends from the base section 32 in a general opposite direction relative to the first contact section 34. The second contact section 36 extends from the top side of the base section 32 and is bent in a downward direction. An end 48 of the second contact section 36 is bent to extend in a really outward direction. Thus, the contact leg has a general L shape. The end 48 is located adjacent the ledge 30 of the inner housing member 18. The second contact section 36 wraps around a portion 50 of the inner housing member 18. The housing portion 50 provides structural support and positioning support for the second contact section 36.

Gas generators, such as for vehicle safety air bags, are generally well known in the art. These well known gas generators comprise members such as the outer housing 14, an electrical connector having the pin contacts 20 and a shorting contact, and the ignition material 16. The present invention is directed to a new type of electrical connector for a gas generator. As shown best in FIG. 5, when the outer housing 14 is connected to the connector 12, a front end of the outer housing 14 is wrapped in front of the ledge 30 and sandwiches the end 48 of the second contact section 36 against the ledge 30. This connection provides two functions. First, the connection provides a mechanical connection of the shorting contact with the inner housing member 18 and the outer housing member 14. Second, the connection provides an electrical connection between the outer housing member 14 and the shorting contact 22. Thus, the shorting contact 22 electrically connects the electrical terminals 22 to each other and to the outer housing member 14. In alternate embodiments, additional or alternative systems for connecting the second contact section to the outer housing member could be provided.

Because the inner housing member 18 is preferably comprised of merely dielectric material, the inner housing member 18 can be manufactured at a less-expensive cost than a conventional inner housing member with an electrically conductive filler material to dissipate static electricity. With the present invention, static electricity can be dissipated by the electrical connection of the shorting contact 22 with the outer housing member 14. Thus, providing the inner housing member with an electrically conductive filler material is no longer necessary to prevent static electricity buildup. The inner housing member can be manufactured less expensively than the prior art inner housing member having electrically conductive material and, thus, the gas generator igniter of the present invention can be manufactured less expensively than the conventional part gas generator igniter, but still provide the same static electricity dissipation feature.

The present invention can provide relatively easy assembly because the second contact section 36 is merely captured between the front end of the can 14 and the inner housing member 18. No extra assembly step is required. The molded initiator assembly or igniter 10 is more compact than a conventional igniter when fit into an initiator head. The molded initiator assembly 10 provides an assembly having three components all assembled into one unit; the retainer molded into the initiator head, the shorting clip, and the initiator. Thus, the present invention can be provided as a single unit rather than three separate pieces which need to be assembled latter on. The present invention can be manufactured less expensively than the prior art initiator which had an additional metal ring connecting the shorting contact to the outer metal can.

In alternate embodiments, the second contact section 36 could comprise any suitable size and shape. In addition, the second contact section 36 could comprise more than one cantilevered leg. Any suitable type of mechanical connection between the shorting contact and the inner housing member could be provided. Any suitable shape or size of first contact section could also be provided. Features of the present invention could be used in any suitable type of gas generator igniter. In addition, the shorting contact of the present invention could be used in any suitable type of electrical connector.

Figure 6:
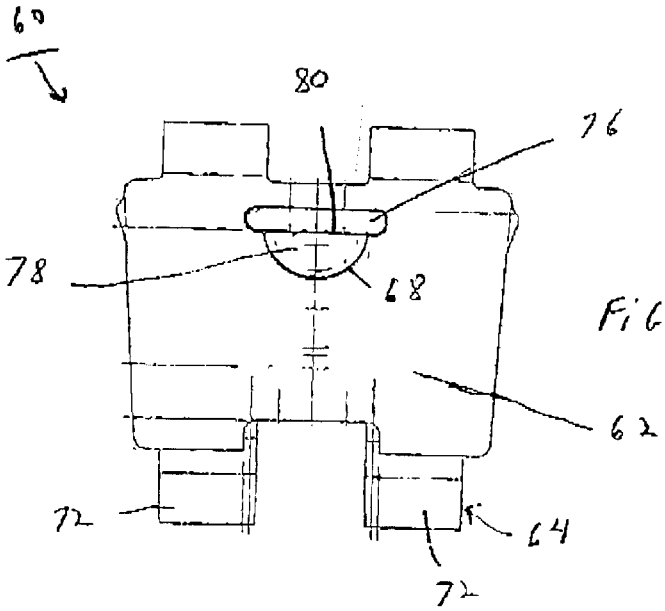
FIG. 6 is a rear side elevational view of another embodiment of a shorting contact.
Figure 7:
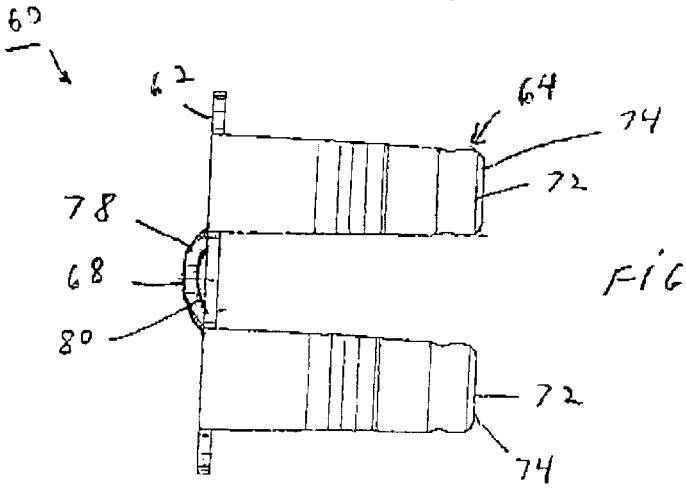
FIG. 7 is a top plan view of the contact shown in FIG. 6.
Figure 8:
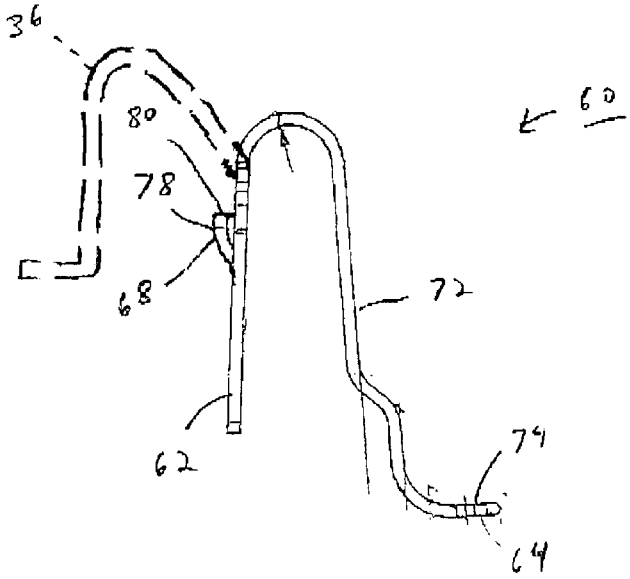
FIG. 8 is a side elevational view of the contact shown in FIG. 6.

Referring now also to FIGS. 6–8, an alternate embodiment of a shorting contact is shown. In this embodiment the shorting contact 60 generally comprises a base section 62 and a first contact section 64. The shorting contact 60 is preferably comprised of sheet metal which has been stamped and formed into the shape shown. Portions of the shorting contact may be plated with suitable plating material.

In this embodiment the shorting contact 60 does not comprise a second contact section 36. However, it could be provided as illustrated in FIG. 8. In the embodiment shown, the base section 62 is substantially flat except for a mounting section 68. The mounting section 68 comprises a deflectable tab. As noted above, the shorting contact receiving area 28 comprises a snap lock ledge 40 therein (see FIG. 5). When the base section 62 is inserted into the shorting contact receiving area 28 the mounting section 68 is adapted to deflect and snap lock mount behind the snap lock ledge 40. However, in alternate embodiments, any suitable type of system for mounting the shorting contact to the inner housing member could be provided. The outer housing 14 could comprise a tab for contacting the shorting contact 60.

The first contact section 64 comprises two cantilevered deflectable arms 72. However, in alternate embodiments, the first contact section 64 could comprise more or less than two cantilevered deflectable arms. The two arms 72 are substantially identical to each other. However, in alternate embodiments, the arms could comprise different shapes and/or sizes. The arms 72 extend upward from a top side of the base section 62 and are bent towards a downward direction. Bottom ends 74 of the arms 72 extend in an inward direction when mounted to the inner housing member 18. End tips of the bottom ends 74 are adapted to contact the electrical terminals 20. Thus, the shorting contact 60 is adapted to electrically connect the two electrical terminals 20 to each other. The cantilevered arms 72 are resiliently deflectable away from the electrical terminals 20 when the mating electrical connector (not shown) is inserted into the mating connector receiving area 26.

The mounting section 68 is formed by a slot aperture 76 through the base section 62 and a semi-dome shaped projection 78 at the bottom of the slot 76. The top surface 80 of the semi-dome shaped projection 78 forms a latching surface for latching with the housing. However, the semi-dome shaped projection 78 can still resiliently deflect inward when being mounted to the inner housing member 18. The semi-dome shaped projection 78 provides more surface area for latching with the inner housing member 18 and provides a ramp shaped bottom surface for easier mounting with the inner housing member 18.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An igniter shorting contact for an igniter connector comprising:

a base adapted to be mounted to an insulating housing member of a housing of the igniter connector;

at least one deflectable contact arm extending from a top end of the base and bent downward, and adapted to contact electrical terminals of the igniter connector; and a contact leg extending from a top end of the base and bent downward, the contact leg being adapted to extend radially outward on the insulating housing and contact an outer electrically conductive housing member, wherein an end of the contact leg comprises a general L shape.

2. An igniter shorting contact as in claim 1 wherein the contact leg extends away from the base in a general opposite direction relative to the at least one deflectable contact arm.

3. An igniter shorting contact as in claim 1 wherein the base comprises a tab for snap-lock mounting with the insulating housing member.

4. A gas generator igniter connector comprising:

a housing;

electrical terminals mounted to the housing; and a shorting contact as in claim 1 connected to the housing.

5. A gas generator igniter connector comprising:

a housing comprising an inner electrically insulating member and an outer electrically conductive member;

electrical terminals mounted to the insulating member; and a shorting contact connected to the housing, the shorting contact comprising a first deflectable contact section, which extends from a top end of the mounting base section and is bent downward, and is adapted to contact the electrical terminals and a second contact section, which extends from a top end of a mounting base section of the shorting contact and is bent downward, and is directly electrically connected to the outer electrically conductive member of the housing, an end of the second contact section comprising a general cantilevered L shape, wherein the shorting contact directly connects the terminals to each other and to the outer electrically conductive member.

6. A gas generator igniter connector as in claim 5 wherein the second contact section extends away from a mounting section of the shorting contact in a general opposite direction relative to the first contact sections.

7. An igniter shorting contact as in claim 5 wherein the outer electrically conductive member comprises an outer housing of a gas generator igniter.

8. A gas generator igniter connector comprising:

a housing comprising an inner electrically insulating member and an outer electrically conductive member;

electrical terminals mounted to the insulating member; and a shorting contact connected to the housing, the shorting contact comprising a first deflectable contact section adapted to contact the electrical terminals and a second contact section directly electrically connected to the outer electrically conductive member of the housing, wherein the shorting contact directly connects the terminals to each other and to the outer electrically conductive member;

wherein an end of the second contact section comprises a general cantilevered L shape and the second contact section extends from a top end of a mounting base section of the shorting contact and is bent downward, wherein the mounting base section comprises a tab for snap-lock mounting with the insulating housing member.

9. A method of assembling a gas generator igniter connector comprising steps of:

inserting a shorting contact into an insulating housing member of the connector;

contacting electrical terminals of the connector with first deflectable contact sections of the shorting contact; and contacting an electrically conductive housing member of the connector with a second contact section of the shorting contact, wherein the shorting contact electrically connects the terminals to each other and to the electrically conductive housing member, and the electrically conductive housing member mechanically sandwiches a portion of the second contact section against the insulating housing member.

10. A method as in claim 9 wherein the shorting contact member comprises an outward extending contact leg which is contacted by the electrically conductive housing member.

11. An igniter shorting contact for an igniter connector comprising:

a base adapted to be mounted to an insulating housing member of a housing of the igniter connector; and at least one deflectable contact arm extending from a top end of the base and bent downward, and adapted to contact electrical terminals of the igniter connector;

wherein the base comprises a tab for snap-lock mounting with the insulating housing member, the tab comprising a semi-dome shaped projection which deflects inward when mounted to an inner housing member.

12. An igniter shorting contact for an igniter connector comprising:

a base adapted to be mounted to an insulating housing member of a housing of the igniter connector;

at least one deflectable contact arm extending from a top end of the base and bent downward, and adapted to contact electrical terminals of the igniter connector; and a contact leg extending from a top end of the base and bent downward, the contact leg being adapted to extend radially outward on the insulating housing and contact an outer electrically conductive housing member.

13. A gas generator igniter connector comprising:

a housing comprising an inner electrically insulating member and an outer electrically conductive member;

electrical terminals mounted to the insulating member; and a shorting contact connected to the housing, the shorting contact comprising a first deflectable contact section, which extends from a top end of the mounting base section and is bent downward, and is adapted to contact the electrical terminals and a second contact section, which extends from a top end of a mounting base section of the shorting contact and is bent downward, and is directly electrically connected to the outer electrically conductive member of the housing, wherein the shorting contact directly connects the terminals to each other and to the outer electrically conductive member.

* * * * *